US008933775B2

(12) United States Patent
Wang et al.

(10) Patent No.: US 8,933,775 B2
(45) Date of Patent: Jan. 13, 2015

(54) SURFACE MOUNTABLE OVER-CURRENT PROTECTION DEVICE

(71) Applicant: Polytronics Technology Corp., Hsinchu (TW)

(72) Inventors: David Shau Chew Wang, Taipei (TW); Fu Hua Chu, Taipei (TW); Chun Teng Tseng, Miaoli (TW)

(73) Assignee: Polytronics Technology Corporation, Hsinchu (TW)

( * ) Notice: Subject to any disclaimer, the term of this patent is extended or adjusted under 35 U.S.C. 154(b) by 115 days.

(21) Appl. No.: 13/910,880

(22) Filed: Jun. 5, 2013

(65) Prior Publication Data

US 2014/0091896 A1 Apr. 3, 2014

(30) Foreign Application Priority Data

Sep. 28, 2012 (TW) ..... 101136132 A

(51) Int. Cl.

| | |
|---|---|
| ***H01C 7/10*** | (2006.01) |
| ***H01C 7/13*** | (2006.01) |
| ***H01C 7/02*** | (2006.01) |
| ***H01C 1/08*** | (2006.01) |
| ***H01C 1/14*** | (2006.01) |
| *H01C 17/065* | (2006.01) |

(52) U.S. Cl.

CPC ..... *H01C 7/021* (2013.01); *H01C 1/08* (2013.01); *H01C 1/1406* (2013.01); *H01C 7/027* (2013.01); *H01C 17/0652* (2013.01); *H01C 17/06526* (2013.01); *H01C 17/06566* (2013.01)

USPC ..... 338/22 R; 338/13

(58) Field of Classification Search

CPC ..... H01C 17/0652; H01C 17/06526; H01C 17/06566; H01C 1/08; H01C 1/1406; H01C 7/021; H01C 7/027; H01C 7/12; H01C 7/02; H01C 1/028

USPC ..... 338/22 R, 13

See application file for complete search history.

(56) References Cited

U.S. PATENT DOCUMENTS

| | | | | |
|---|---|---|---|---|
| 6,020,808 | A * | 2/2000 | Hogge | 338/22 R |
| 6,157,289 | A * | 12/2000 | Kojima et al. | 338/22 R |
| 6,480,094 | B1 * | 11/2002 | Chen et al. | 338/328 |
| 7,026,583 | B2 * | 4/2006 | Tu et al. | 219/541 |
| 8,044,763 | B2 | 10/2011 | Wang et al. | |
| 2001/0015688 | A1 * | 8/2001 | Li et al. | 338/22 R |
| 2010/0134942 | A1 * | 6/2010 | Wang et al. | 361/93.7 |
| 2012/0227229 | A1 | 9/2012 | Montoya et al. | |

FOREIGN PATENT DOCUMENTS

| | | | |
|---|---|---|---|
| TW | I358071 | A | 2/2012 |
| TW | 201214913 | A1 | 4/2012 |

* cited by examiner

*Primary Examiner* — Kyung Lee

(74) *Attorney, Agent, or Firm* — Shimokaji & Associates P.C.

(57) ABSTRACT

A surface-mountable over-current protection device comprises one PTC material layer, first and second connecting conductors, first and second electrodes and an insulating layer. The PTC material layer has a resistivity less than 0.2 Ω-cm, and comprises crystalline polymer and conductive filler dispersed therein. The first and second connecting conductors are capable of effectively dissipating heat generated from the PTC material layer. The first and second electrodes are electrically connected to first and second surfaces of the PTC material layer through the first and second connecting conductors, respectively. The dissipation factor depending on the ratio of the total area of the electrodes and the conductors to the area of the PTC material layer is greater than 0.6. At 25° C., the value of the hold current of the device divided by the product of the area of the PTC material layer and the number of the PTC material layer is greater than 1A/mm$^2$.

31 Claims, 5 Drawing Sheets

SURFACE MOUNTABLE OVER-CURRENT PROTECTION DEVICE

BACKGROUND OF THE INVENTION (1) Field of the Invention

The present application relates to a surface mountable over-current protection device, and more particularly to a surface mountable over-current protection device with high hold current and positive temperature coefficient (PTC) characteristics.

(2) Description of the Related Art

Because the resistance of conductive composite materials having PTC characteristic is very sensitive to temperature variation, it can be used as the material for current sensing devices, and has been widely applied to over-current protection devices or circuit devices. The resistance of the PTC conductive composite material remains extremely low at normal temperature, so that the circuit or cell can operate normally. However, when an over-current or an over-temperature event occurs in the circuit or cell, the resistance instantaneously increases to a high resistance state (e.g., at least $10^2\Omega$), so as to suppress over-current and protect the cell or the circuit device.

In general, the PTC conductive composite contains at least one crystalline polymer and conductive filler. The conductive filler is dispersed uniformly in the crystalline polymer. The crystalline polymer is mainly a polyolefin polymer or a fluoropolyolefin polymer such as polyethylene, polyvinyl fluoride or polyvinylidene fluoride (PVDF). The conductive filler(s) is mainly carbon black.

The conductivity of the PTC conductive composite depends on the content and type of the conductive fillers. In general, the resistivity of the PTC conductive composite containing the carbon black as the conductive filler seldom reaches below 0.2 Ω-cm. Even though the low resistivity below 0.2 Ω-cm is achieved, the PTC conductive composite often loses the characteristic of voltage endurance. Therefore, a conductive filler, which is different from carbon black, with lower resistance should be used in the PTC conductive composite to reach a resistivity below 0.2 Ω-cm. The conductivity of carbon black is relatively low (i.e., relatively high resistance). If carbon black is applied to a surface mountable device (SMD) with fixed covered area, the hold current of the SMD is limited to certain level due to the resistance limitation of carbon black. The hold current indicates a maximum current that the PTC device can endure before trip at a specific temperature.

Although a multi-layer PTC structure could be used to increase the hold current, SMD over-current protection device performance is eventually limited due to the limitation of total height as well as the number of PTC layers of the SMD device. In general, for an SMD over-current protection device including a single PTC layer having carbon black, the ratio of the hold current to the area of a PTC material layer cannot exceed 0.16 A/mm$^2$ The SMD over-current protection devices currently available in the market have a certain shape characterized by the width and the length, which are defined as a form factor in the specification. Consequently, the length and width of the SMD over-current protection device determine its covered area. For example, SMD 1812 indicates a SMD with a length of 0.18 inches and a width of 0.12 inches, and thus a covered area is equal to 0.18"×0.12", which is equivalent to 4.572 mm×3.048 mm=13.9355 mm$^2$ in metric system. For an over-current protection device of SMD 1812 using carbon black as the conductive filler, a single PTC material layer hardly reaches a hold current of 1.8 A. If the SMD 1812 having two PTC material layers can hold a current up to 3.6 A, the hold current per unit covered area of a single PTC material layer can be calculated as: 3.6 A/(2×13.9355 mm$^2$)=0.129 A/mm$^2$, which is below 0.16 A/mm$^2$. Therefore, it is highly desirable that a new type SMD device could be developed to exceed the 0.16 A/mm$^2$ barrier.

U.S. Pat. No. 8,044,763 disclosed the use of conductive filler with low resistivity such as metal powder or metal carbide for SMD devices to break through the limitation of carbon black. Accordingly, the hold current per PTC area can increase to larger than 0.16 A/mm$^2$, or up to 1 A/mm$^2$. However, as the rapid advancement of the mobile communication, the mobile apparatuses are demanded to be lightweight, compact and more powerful. Therefore, larger operating current is needed and the hold current per PTC area of 1 A/mm$^2$ is not enough for current PTC protection applications. The PTC devices have to be improved to obtain higher hold current per unit PTC area, so as to make PTC devices of larger current with smaller PTC area.

SUMMARY OF THE INVENTION

The present application is to provide a surface mountable over-current protection device, in which conductive filler of high conductivity and good heat dissipation structure are utilized. This enables the surface mountable over-current protection device to exhibit excellent resistivity and high hold current.

In accordance with an embodiment of the present application, a surface mountable over-current protection device comprises at least one PTC material layer, a first connecting conductor, a second connecting conductor, a first electrode, a second electrode and at lease one insulating layer. The PTC material layer has opposite first and second planar surfaces and its resistivity is less than 0.2 Ω-cm. The PTC material layer comprises crystalline polymer and conductive filler of a resistivity less than 500μΩ-cm dispersed therein. The first connecting conductor and the second connecting conductor have to be capable of effectively dissipating the heat generated by the PTC material layer. The first electrode is electrically connected to the first surface of the PTC material layer through the first connecting conductor, whereas the second electrode is electrically connected to the second surface of the PTC material layer through the second connecting conductor. The insulating layer is disposed between the first electrode and the second electrode for electrical isolation. The over-current protection device has a heat dissipation factor (A1+A2)/A3 greater than 0.6, where A1 is the sum of the areas of the first electrode and the second electrode, A2 is the sum of the areas of the first connecting conductor and the second connecting conductor, and A3 is the product of the area of the PTC material layer and the number of the PTC material layers, i.e., the total area of the PTC material layer. The surface mountable over-current protection device of the present application, at 25° C., indicates that the hold current thereof divided by the product of the area of the PTC material layer and the number of the PTC material layers is greater than 1 A/mm$^2$.

In an embodiment, a first metal foil and a second metal foil can be adhered to the first surface and the second surface of the PTC material layer, respectively, to form a PTC device. In other words, the PTC material layer is laminated between the first metal foil and the second metal foil. The first electrode is electrically connected to the first metal foil on the PTC material layer through the first connecting conductor, and the second electrode is electrically connected to the second metal foil on the PTC material layer through the second connecting conductor.

In an embodiment, the first or second metal foils may be view as a part of the connecting conductors if they are capable of effectively dissipating the heat generated by the PTC material layer.

When heat dissipation efficiency increases, the heat of PTC material layer can be transferred to outside more rapidly. Therefore, the temperature incremental rate of the PTC material will be diminished, and as a result the SMD over-current protection device can acquire higher hold current. If the heat dissipation factor is greater than 0.6, the hold current per unit area of the over-current protection device can increase to be greater than 1 A/mm$^2$ due to good heat dissipation efficiency and the use of low resistivity material.

BRIEF DESCRIPTION OF THE DRAWINGS

The present application will be described according to the appended drawings in which.

DETAILED DESCRIPTION OF THE INVENTION

Figure 1:
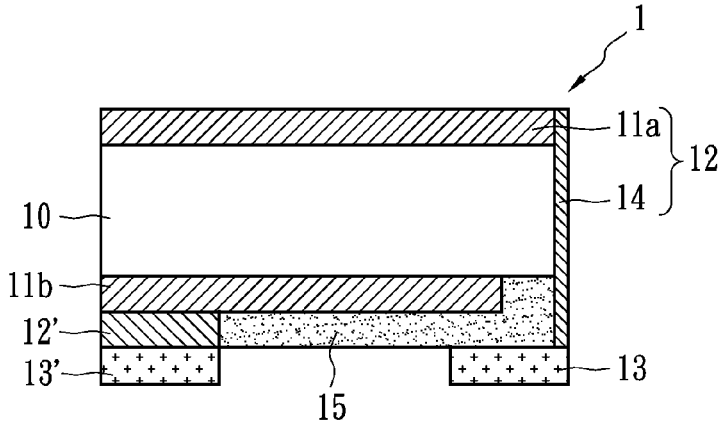
FIGS. 1 to 8 show surface mountable over-current protection devices in accordance with many embodiments of the present application.

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

To increase the hold current per PTC area to be more than 1 A/mm$^2$, it is desirable to have large heat conductivity or dissipation design for the SMD over-current protection devices of low resistivity. The current flowing through the PTC material of SMD over-current protection device will generate heat due to the resistance thereof, the amount of heat is proportional to the area of the PTC material layer $A_{PTC}$. The heat is transferred from the PTC material layer to outside, i.e., the heat is transferred to the surface of the device through connecting conductors and electrodes, and then the heat is dissipated to ambient environment. Accordingly, the heat dissipation relates to the total area of the electrodes and connecting conductors. The ratio of the heat dissipation of the electrodes and connecting conductors to the heat generation of the PTC material layer can be defined as a heat dissipation factor "F."

F=(A1+A2)/A3, where A1 is the total area of the electrodes, A2 is the total area of the connecting conductors, and A3 is the total area of the PTC material layer; i.e., A3 is substantially equal to $A_{PTC}$×the number of the PTC material layers.

The connecting conductors are used to electrically connect the PTC material layer and the electrodes, and serves as electrical and heat conductive paths. Therefore, the connecting conductor has to be capable of effectively dissipating the heat generated by the PTC material layer. The heat conductivity or dissipation is proportional to the area of the connecting conductors.

The connecting conductor is usually made of metal, and can be in the shape of cylinder, semicircular cylinder, elliptic cylinder, semi-elliptic cylinder, plane or sheet. The connecting conductor can be formed in a via, a blind via, or wraps around a full sidewall surface or a part of the sidewall surface, so as to form conductive through hole, conductive blind hole or conductive side surface. As to the SMD over-current protection device having single side electrode, the most upper metal foil on the PTC material layer is disposed on device surface and therefore it can be viewed as a connecting conductor in consideration of its efficient heat dissipation. The most upper metal foil can be fully exposed or only covered by a thin insulating layer such as insulating paint or text ink. The connecting conductor may be of various shapes, the area of the connecting conductor most commonly used can be calculated as follows.

For a connecting conductor of cylinder shape such as a circular through hole, A2=π×the diameter of the cylinder×the length of the cylinder (or the thickness of the device).

For a connecting conductor in partial cylinder shape such as a semicircular or quadrant through hole, A2=the arc of the partial cylinder×the length of the partial cylinder (or the thickness of the device).

For a blind hole, A2=π×the diameter of the blind hole×the length of the blind hole.

For a connecting conductor on a full sidewall surface, A2=the width of the device×the thickness of the device.

It can be known from the following embodiments that the hold current of various SMD devices will increase if the heat dissipation factor can be well controlled. When the heat dissipation efficiency increases, the heat generated by the PTC material layer will be dissipated rapidly. As a consequence, the incremental rate of temperature of the PTC material layer is diminished, and therefore the over-current protection device can exhibit higher hold current.

FIG. 1 illustrates the first embodiment of the surface mountable over-current protection device 1, which is suitable to be secured to a substrate (not shown). A first electrode 13 and a second electrode 13' corresponding to the first electrode 13 are usually located on the same plane. The surface mountable over-current protection device 1 could be designed to contain only one electrode set comprising the first electrode 13 and the second electrode 13' such that only a specific surface thereof could adhere to the surface of the substrate. The design in FIG. 1 is usually applied to a narrow space and meets the requirements of one-way heat conduction or one-way heat insulation. In this embodiment, the first electrode 13, a conductor 14, a first metal foil 11*a*, a PTC material layer 10, a second metal foil 11*b*, a connecting conductor 12', and the second electrode 13' form a conductive circuit to connect an external device (not shown) and a power source (not shown). In addition, an insulating layer 15 is disposed between the first electrode 13 and the second electrode 13' to electrically insulate the first electrode 13 from the second electrode 13'. Because the first metal foil 11*a* is disposed on the device surface, it can effectively dissipate the heat generated from the PTC material layer 10. Therefore, the first metal foil 11*a* is viewed as a part of a connecting conductor 12. More specifically, the connecting conductor 12 comprises the first metal foil 11*a* and the conductor 14 connecting the first electrode 13 and the first metal foil 11*a*. The conductor 14 may be a conductive through hole, a conductive blind hole or a conductive sidewall. In this embodiment, A1 is the total area of the first electrode 13 and the second electrode 13', A2 is the total area of the first connecting conductor 12 and the second connecting conductor 12', and A3 is the area of the PTC material layer 10.

Figure 2:
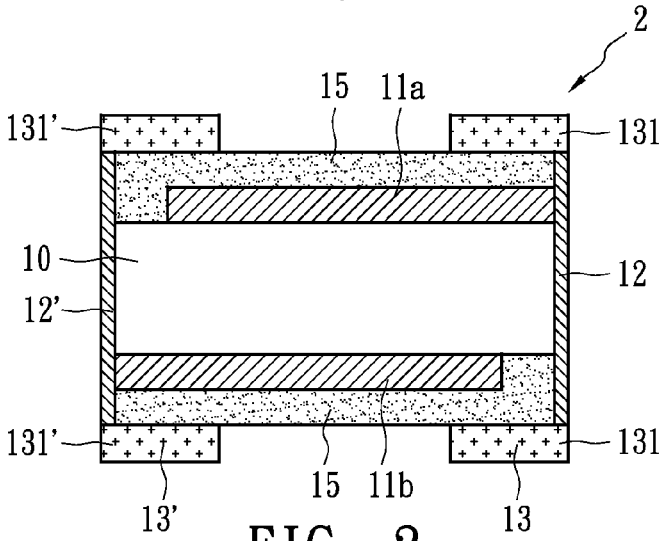

FIG. 2 illustrates the second embodiment of the surface mountable over-current protection device 2, which is designed to contain two electrode sets, each comprising the first electrode 13 and the second electrode 13', on the top and the bottom surface thereof, respectively. Thus, the first and second electrodes 13 and 13' form a positive electrode and a negative electrode on the top surface and the bottom surface of the surface mountable over-current protection device 2 such that either of the top and the bottom surfaces could be used to adhere to the surface of the substrate. Therefore, there is no up-and-down directionality concern during the design, and the manufacturing process (e.g., the selection of resistors, device packaging, device assembly and the manufacturing process of the printed circuit board) is simplified. Similar to the first embodiment, the second embodiment employs insulating layers 15 to electrically insulate the first electrode 13 from the second electrode 13'. More specifically, the first electrode 13 comprises a pair of first electrode layers 131, and the second electrode 13' comprises a pair of second electrode layers 131'. The first electrode layers 131 and the second electrode layers 131' are disposed on the insulating layers 15. The first connecting conductor 12 connects the pair of the first electrode layers 131 and the first metal foil 11*a*, and the second connecting conductor 12' connects the pair of the second electrode layers 131' and the second metal foil 11*b*. Compared to the embodiment of FIG. 1, the metal foils 11*a* and 11*b* of this embodiment cannot be viewed a part of the connecting conductor capable of effectively dissipating heat because the insulating layers 15 on the metal foils 11*a* and 11*b* hinder heat from transferring out of the PTC material layer 10. In this embodiment, A1 is the total area of the first electrode 13 and the second electrode 13', A2 is the total area of the first connecting conductor 12 and the second connecting conductor 12', and A3 is the area of the PTC material layer 10.

Figure 3:
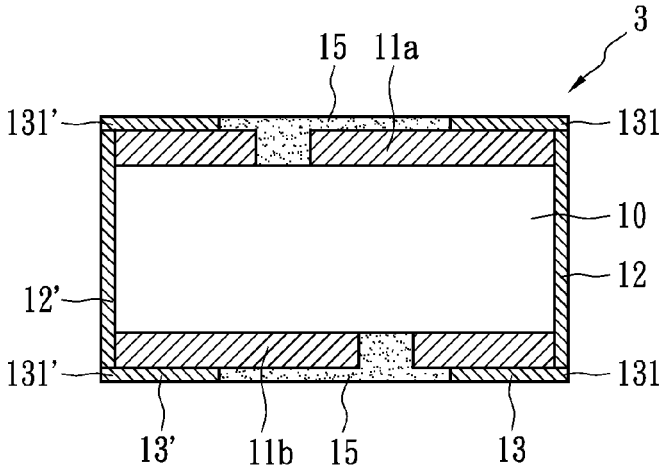

FIG. 3 illustrates the third embodiment of the surface mountable over-current protection device 3, in which the first connecting conductor 12 and the second connecting conductor 12' are developed by metallic electroplating on sidewall surfaces of the surface mountable over-current protection device 3 to form wrap-around electrical conductors. The first connecting conductor 12 connects the pair of the first electrode layers 131 and the first metal foil 11*a*, and the second connecting conductor 12' connects the pair of the second electrode layers 131' and the second metal foil 11*b*. The upper first electrode layer 131 contacts the surface of the first metal foil 11*a*, and the lower second electrode layer 131' contacts the surface of the second metal foil 11*b*. In addition, the first and the second connecting conductors 12 and 12' connecting the first and the second metal foils 11*a* and 11*b* and electrodes 13 and 13' can be formed by soldering, electroplating, and then reflow and heat-curing. In this embodiment, the first and the second connecting conductors 12 and 12' can also be formed by first forming micro holes and then plating-through-hole or metal filling. A1 is the total area of the first electrode 13 and the second electrode 13', A2 is the total area of the first connecting conductor 12 and the second connecting conductor 12', and A3 is the area of the PTC material layer 10.

Figure 4:
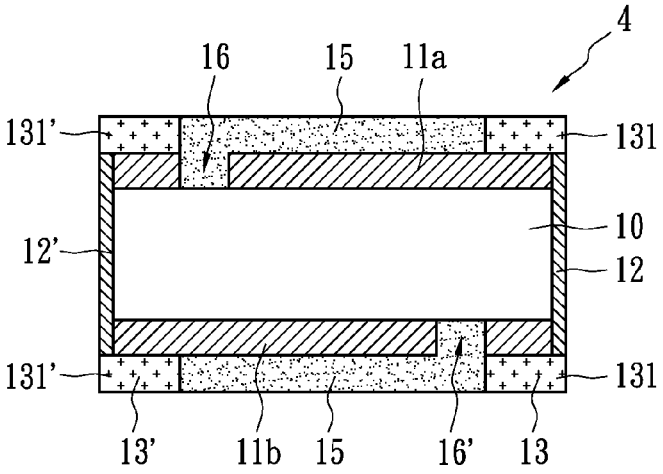

FIG. 4 illustrates the fourth embodiment of the surface mountable over-current protection device 4. A first electrode 13 comprises a pair of first electrode layers 131, and a second electrode 13' comprises a pair of second electrode layers 131'. A first connecting conductor 12 connects to the first electrode layers 131 and the first metal foils 11*a*, and the second connecting conductor 12' connects to the second electrode layers 131' and the second metal foils 11*b*. The first metal foil 11*a* is formed by etching and is electrically insulated from the second electrode 13' and the second connecting conductor 12' by an etching line 16 (or etching area). Similarly, the second metal foil 11*b* is formed by etching and is electrically insulated from the first electrode 13 and the first connecting conductor 12 by an etching line 16' (or etching area). In this embodiment, A1 is the total area of the first electrode 13 and the second electrode 13'; A2 is the total area of the first connecting conductor 12 and the second connecting conductor 12'; A3 is the area of the PTC material layer 10.

Figure 5:
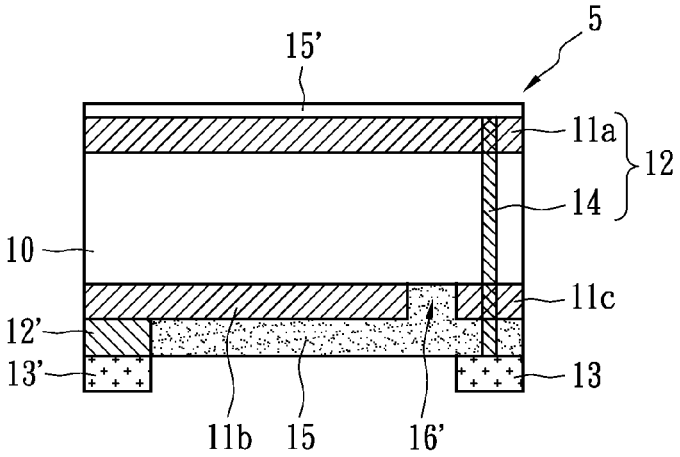

FIG. 5 illustrates the fifth embodiment of the surface mountable over-current protection device 5, which relates to the SMD over-current protection device like that shown in FIG. 1. The connecting conductor 14 may be conductive through hole or conductive post that connects to a first metal foil 11*a*, a third metal foil 11*c* and the first electrode 13. The third metal foil 11*c* is formed by etching and is electrically insulated from the second metal foil 11*b* by an etching line 16' (or etching area). An insulating layer 15 overlays the metal foils 11*b* and 11*c*. The second metal foil 11*b* is connected to the second electrode 13' through the connecting conductor 12'. Moreover, the third metal foil 11*c*, which adheres to the PTC material layer 10, and the second metal foil 11*b* are located on the same plane. The first metal foil 11*a* is covered by a thin insulating layer 15' such as insulating paint or text ink. The insulating layer 15' is so thin that it would not hinder the heat transfer of the first metal foil 11*a*. Thus, the first metal foil 11*a* can dissipate the heat generated from the PTC material layer 10 effectively, and is viewed a part of the connecting conductor 12. The connecting conductor 12 comprises the first metal foil 11*a* and the connecting conductor 14 connecting the first electrode 13 and the first metal foil 11*a*. In this embodiment, A1 is the total area of the first electrode 13 and the second electrode 13', A2 is the total area of the connecting conductor 12 and the connecting conductor 12', and A3 is the area of the PTC material layer 10.

Figure 6:
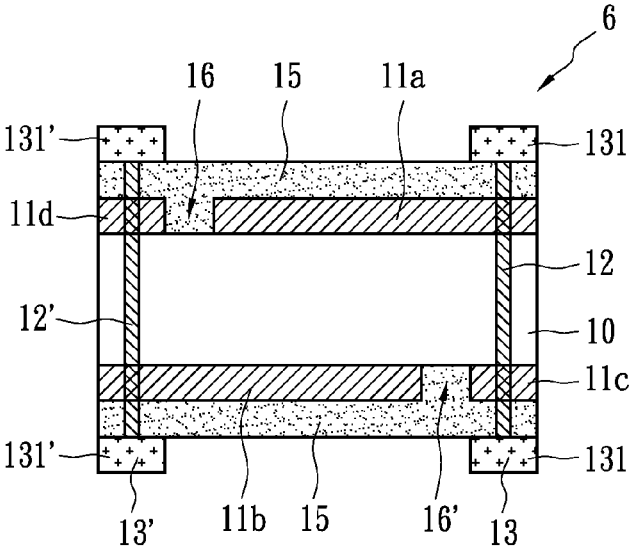

FIG. 6 illustrates the sixth embodiment of the surface mountable over-current protection device 6. A first electrode 13 comprises a pair of first electrode layers 131 on the upper and lower surfaces of the device 6. The second electrode 13' comprises a pair of the second electrode layers 131' on the upper and lower surfaces of the device 6. A first connecting conductor 12 electrically connects the first electrode layers 131, the first metal foil 11*a* and a third metal foil 11*c* through a conductive through hole or conductive post, and the third metal foil 11*c* is formed by etching and is electrically insulated from the second metal foil 11*b* by an etching line 16' (or etching area). The second connecting conductor 12' electrically connects to the second electrode layers 131', the second metal foil 11*b* and a fourth metal foil 11*d* through a conductive through hole or a conductive post, and the fourth metal foil 11*d* is formed by etching and is electrically insulated from the first metal foil 11*a* by an etching line 16 (or etching area). In addition, the fourth metal foil 11*d*, which adheres to the PTC material layer 10, and the first metal foil 11*a* are located on the same plane. In this embodiment, A1 is the total area of the first electrode 13 and the second electrode 13', A2 is the total area of the first connecting conductor 12 and the second connecting conductor 12', and A3 is the area of the PTC material layer 10.

Figure 7:
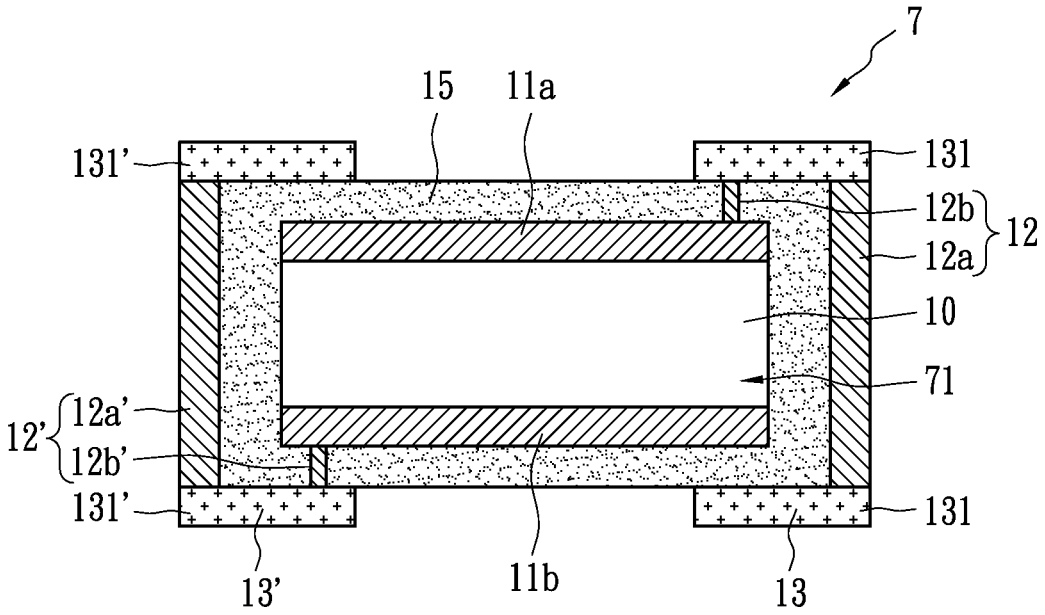

FIG. 7 illustrates the seventh embodiment of the surface mountable over-current protection device 7. The over-current protection device 7 comprises a PTC device 71, a first connecting conductor 12, a second connecting conductor 12', a first electrode 13 and a second electrode 13'. The PTC device 71 comprises a first metal foil 11*a*, a second metal foil 11*b* and a PTC material layer laminated therebetween. The first electrode 13 comprises a pair of first electrode layers 131 on the upper and lower surfaces of the device 7, and the second electrode comprises a pair of second electrode layers 131' on the upper and lower surfaces of the device 7. An insulating layer 15 encompasses the PTC device 71. The first connecting conductor 12 comprises a conductor 12*a* and a conductor 12*b*. The conductor 12*a* may be a conductive through hole, a conductive blind hole or a conductive sidewall which connects the pair of the first electrode layers 131. The conductor 12*b* may be conductive hole or conductive post which connects the upper first electrode layer 131 and the first metal foil 11*a*. The second connecting conductor 12' comprises a conductor 12*a'* and a conductor 12*b'*. The conductor 12*a'* may be a conductive through hole, a conductive blind hole or a conductive sidewall which connects the pair of the second electrode layers 131'. The conductor 12*b'* may be conductive hole or conductive post which connects the lower second electrode layer 131' and the second metal foil 11*b*. In this embodiment, A1 is the total area of the first electrode 13 and the second electrode 13', A2 is the total area of the first connecting conductor 12 and the second connecting conductor 12', and A3 is the area of the PTC material layer 10.

Figure 8:
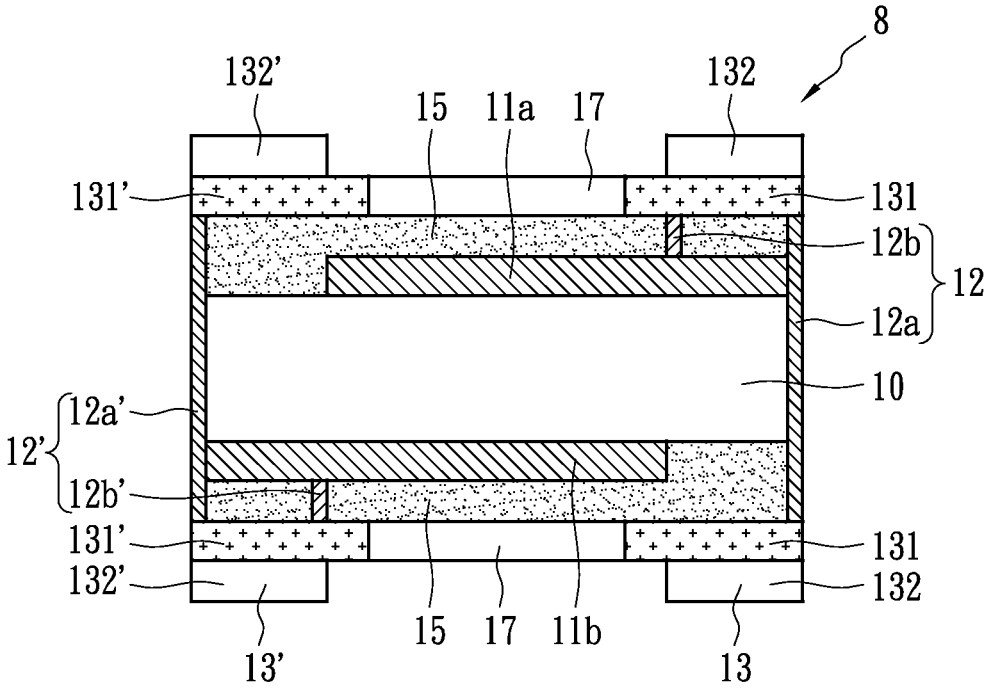

FIG. 8 illustrates the eighth embodiment of the surface mountable over-current protection device 8. Like that shown in FIG. 2, but the first connecting conductor 12 further comprises a conductor 12*b* such as a conductive through hole, a conductive blind hole or a conductive sidewall to connect the upper first electrode layer 131 and the metal foil 11*a*; the second connecting conductor 12' further comprises a conductor 12*b'* such as a conductive through hole, a conductive blind hole or a conductive sidewall to connect the lower second electrode layer 131 and the metal foil 11*b*, so as to increase the heat dissipation efficiency. Moreover, the first electrode layer 131 and the second electrode layer 131' may be copper layers. Alternatively, the electrode layers 131 and 131' may be copper layers plated with tin layers 132 and 132' to improve soldering performance. Solder masks 17 are disposed between the first electrode layers 131 and the second electrode layers 131' at the upper and lower surfaces. In this embodiment, A1 is the total area of the first electrode 13 and the second electrode 13', A2 is the total area of the first connecting conductor 12 and the second connecting conductor 12', and A3 is the area of the PTC material layer 10.

A manufacturing process for the surface mountable over-current protection device is exemplified below. The people having ordinary knowledge can implement substantially equivalent or similar process to make the SMD devices mentioned above or the like.

The manufacturing method of the surface mountable over-current protection device of the present application is given as follows. The raw material is set into a blender (Haake-600) at 160° C. for 2 minutes. The procedures of feeding the material are as follows: Crystalline polymer is first loaded into the Haake blender, and the conductive filler is then added into the blender. The rotational speed of the blender is set to 40 rpm. After blending for three minutes, the rotational speed increases to 70 rpm. After blending for seven minutes, the mixture in the blender is drained and thereby a conductive composition with a positive temperature coefficient behavior is formed. Afterward, the above conductive composition is loaded into a mold to form a symmetrical PTC lamination structure with the following layers: steel plate/Teflon cloth/nickel foil/PTC compound (i.e., the conductive composition)/nickel foil/Teflon cloth/steel plate. First, the mold loaded with the conductive composition is pre-pressed for three minutes at 50 kg/cm$^2$ and 160° C. This pre-press process could exhaust the gas generated from vaporized moisture or from some volatile ingredients in the PTC lamination structure. The pre-press process could also drive the air pockets out from the PTC lamination structure. As the generated gas is exhausted, the mold is pressed for additional three minutes at 100 kg/cm$^2$, 160° C. After that, the press step is repeated once at 150 kg/cm$^2$, 160° C. for 3 minutes to form a PTC composite layer.

Figure 9A:
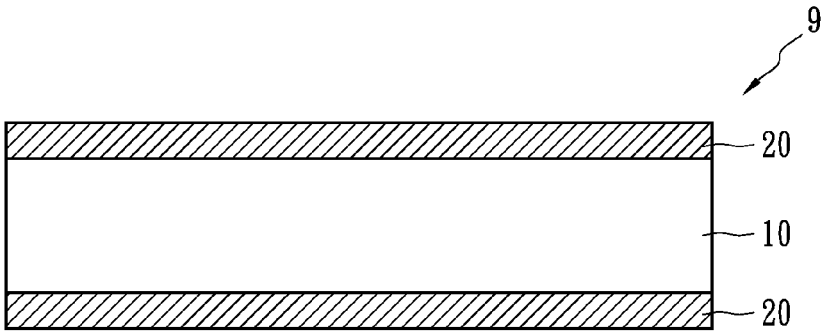
FIGS. 9A to 9C show a manufacturing process of the surface mountable over-current protection device in accordance with an embodiment of the present application.

Referring to FIG. 9A, the PTC composite layer is cut to form plural PTC material layers 10, each with the size of 20×20 cm$^2$. Two metal foils 20 are in physical contact with the top surface and the bottom surface of the PTC material layer 10, in which the two metal foils 20 are symmetrically placed upon the top surface and the bottom surface of the PTC material layer 10. Each metal foil 20 may have a rough surface with plural nodules (not shown) to physically contact the PTC material layer 10. Alternatively, the metal foil 20 may have two smooth surfaces, but one smooth surface and one rough surface are commonly used in which the rough surface containing the nodules is in physical contact with the PTC material layer 10. Next, two Teflon cloths (not shown) are placed upon the two metal foils 20, and then two steel plates (not shown) are placed upon the two Teflon cloths. As a result, all of the Teflon cloths and the steel plates are disposed symmetrically on the top and the bottom surfaces of the PTC material layer 10 to form a multi-layered structure. The multi-layered structure is then pressed for three minutes at 60 kg/cm$^2$ and 180° C., and is then pressed at the same pressure at room temperature for five minutes. After pressing, the multi-layered structure is subjected to gamma-ray radiation of 50 KGy to form a conductive composite module 9, as shown in FIG. 9A.

Figure 9B:
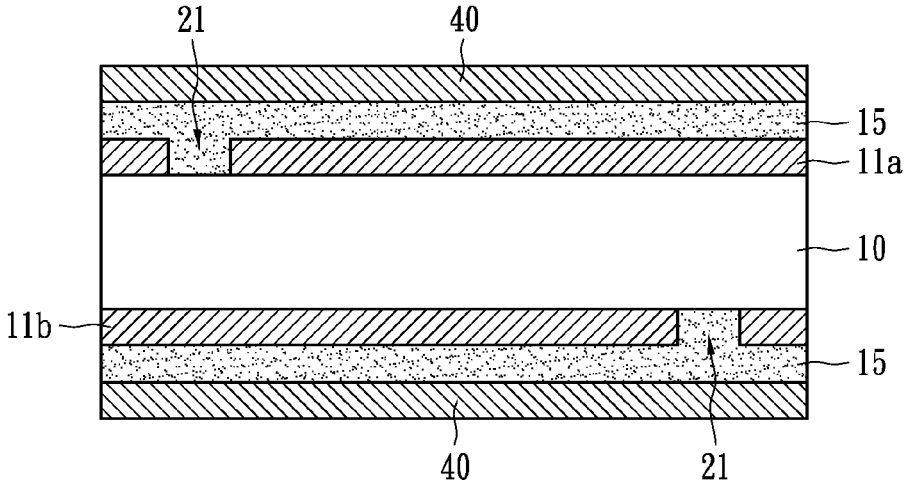

In an embodiment, the metal foils 20 of the above conductive composite module 9 are etched to form two etching lines 21 (refer to FIG. 9B) to form a first metal foil 11*a* on a surface of the PTC material layer 10 and a second metal foil 11*b* on another surface of the PTC material layer 10. Then, insulating layers 15, which may contain the epoxy resin of glass fiber, are disposed on the first and the second metal foils 11*a* and 11*b*, and then copper foils 40 are formed thereon. Again, a hot pressing is performed at 60 kg/cm$^2$ and 180° C. for 30 minutes so as to form a composite material layer comprising one PTC material layer 10 as shown in FIG. 9B.

Figure 9C:
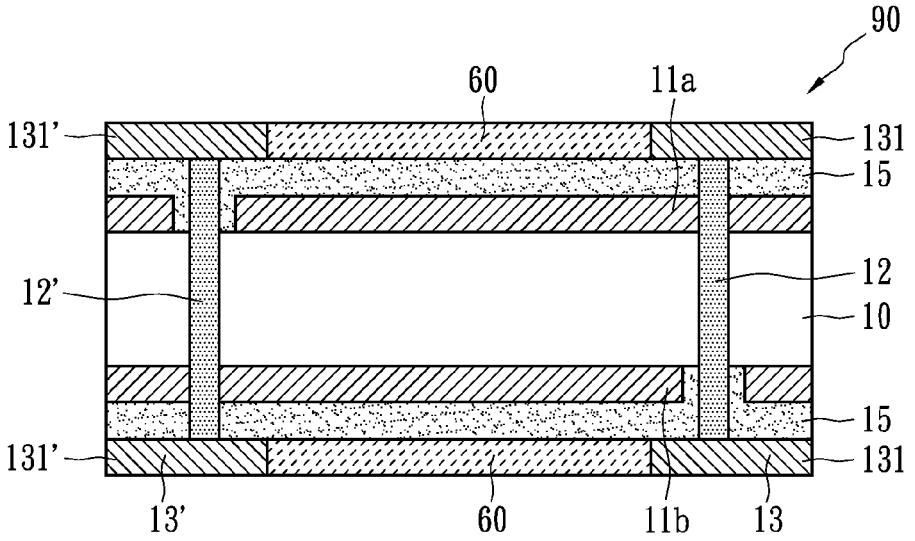

Referring to FIG. 9C, the upper and lower copper foils 40 are etched to form a pair of first electrode layers 131 and a pair of second electrode layers 131' corresponding to the first electrode layers 131, in which a first connecting conductor 12 and a second connecting conductor 12' are formed by plating-through-hole (PTH). The first electrode 13 comprises the pair of the first electrode layers 131, whereas the second electrode 13' comprises the pair of the second electrode layers 131'. The first connecting conductor 12 electrically connects the first metal foil 11*a* and the first electrode layers 131, and the second connecting conductor 12' electrically connects the second metal foil 11*b* and the second electrode layers 131'. Subsequently, insulating layers 60 or the so-called solder masks containing UV-light-curing paint are disposed between the first electrode 13 and the second electrode 13' for insulation, thereby forming a PTC plate. After curing by UV light, the PTC plate is cut according to the size of the device, so as to form SMD over-current protection devices 90.

In addition to the example comprising a single PTC material layer 10, the present application comprises other embodiments containing more PTC material layers 10.

Figure 10:
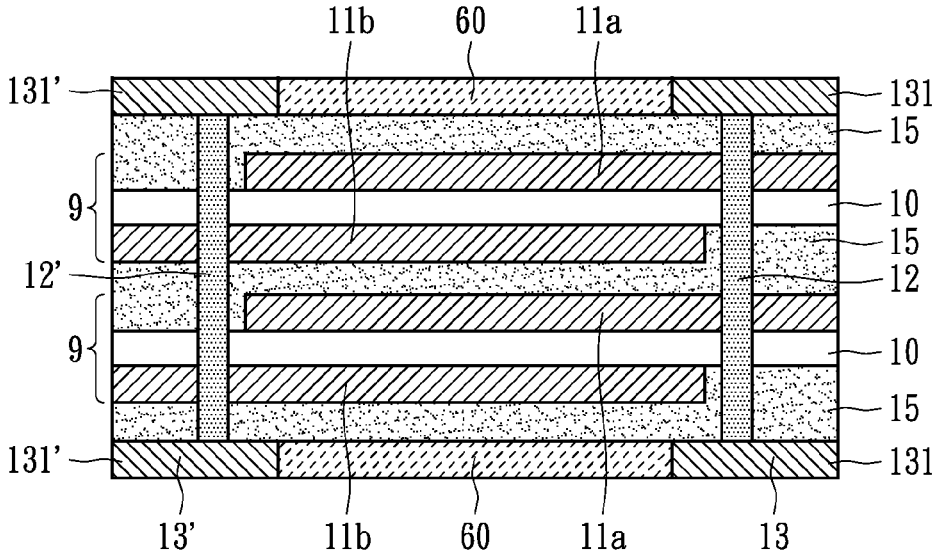
FIG. 10 shows a surface mountable over-current protection device containing two PTC material layers in accordance with another embodiment of the present application.

FIG. 10 illustrates the structure of the surface mountable over-current protection device comprising two PTC material layers 10, whose manufacturing method is given as follows. Two conductive composite modules 9 are provided first. Second, the metal foils 11*a* and 11*b* of each conductive composite module 9 are etched to form etching lines. Third, insulating layers 15, which may use the epoxy resin containing glass fiber, are disposed on the metal foils 11*a* and 11*b* and between the two conductive composite modules 9. Then, a copper foil is placed on the top surface of the upper insulating layer 15 and another copper foil is disposed on the bottom surface of the lower insulating layer 15, followed by hot pressing at 60 kg/cm$^2$ and 180° C. for 30 minutes. After cooling, a multi-layered composite material layer comprising two PTC material layers 10 is formed. Next, the copper foils on the insulating layers 15 are etched to from a pair of first electrode layer 131 and a pair of second electrode layer 131' corresponding to the first electrode layer 131. The first electrode 13 comprises the pair of the first electrode layer 131, and the second electrode 13' comprises the pair of the second electrode layer 131'. After that, connecting conductors 12 and 12' are formed by plating-through-hole, in which the connecting conductor 12 electrically connects the metal foils 11*a* of the conductive composite modules 9 and the first electrode layers 131, and the second connecting conductor 12' electrically connects the metal foils 11*b* of the conductive composite modules 9 and the second electrode layers 131'. Afterward, insulating layers 60, e.g., a UV-light-curing paint, are disposed between the first electrodes 13 and the second electrodes 13' for insulation, thereby forming a multi-layer PTC plate. After UV-curing, the multi-layer PTC plate is cut according to the size of the device to form the SMD over-current protection device comprising multiple PTC material layers 10 or multiple PTC devices 9.

The insulating layers 15 may be composite material comprising epoxy resin and glass fiber, which can be adhesive for jointing the PTC material layers 10 and the metal foils. In addition to epoxy resin, other insulating adhesives like nylon, polyvinylacetate, polyester or polymide can be used alternatively. The insulating layers 60 may be acrylic resins subjected to thermal curing or UV-light curing.

In summary, the SMD over-current protection device essentially comprises at least one PTC material layer 10, a first connecting conductor 12, a second connecting conductor 12', a first electrode 13, a second electrode 13' and one or more insulating layers 15. The PTC material layer 10 is disposed between the first metal foil 11*a* and the second metal foil 11*b* to form PTC device. The first connecting conductor 12 and the second connecting conductor 12' are capable of effectively dissipating the heat generated from the PTC material layer 10. The first electrode 13' is electrically coupled to the first surface (e.g., the upper surface) of the PTC material layer 10 through the first connecting conductor 12, and the second electrode 13' is electrically coupled to the second surface (e.g., the lower surface) of the PTC material layer 10 through the second connecting conductor 12'. The insulating layer 15 is between the first electrode 13 and the second electrode 13' for electrically isolating the first electrode 13 from the second electrode 13'.

In an embodiment, the first connecting conductor 12 comprises a conductive through hole, a conductive blind hole or conductive sidewall extending vertically at a side of the device. The second connecting conductor 12' comprises a conductive through hole, a conductive blind hole or conductive sidewall extending vertically at another side of the device.

According to the single side electrode designs as shown in FIGS. 1 and 5, the first connecting conductor 12 further comprises a first metal foil 11*a* in physical contact with the surface of the PTC material layer 10, and the first metal foil 11*a* extends horizontally.

The compositions and the resistivity (ρ) of the PTC material layers 10 in the surface mountable over-current protection devices of the embodiments Em 1 to Em 8 and comparative examples Comp 1 to Comp 3 are shown in Table 1 below.

TABLE 1

| | HDPE1 (g) | HDPE2 (g) | Ni (g) | WC (g) | TiC (g) | Resistivity (Ω-cm) |
|---|---|---|---|---|---|---|
| Em 1 | 17.8 | 3.2 | — | — | 130 | 0.00492 |
| Em 2 | 20.8 | — | — | 284 | — | 0.00791 |
| Em 3 | 17.8 | 3.2 | — | — | 130 | 0.00492 |
| Em 4 | 21 | — | 27.2 | — | 115 | 0.00653 |
| Em 5 | 17.8 | 3.2 | — | — | 130 | 0.00492 |
| Em 6 | 21.2 | — | 18 | 255 | — | 0.00719 |
| Em 7 | 20.8 | — | — | 284 | — | 0.00791 |
| Em 8 | 20.8 | — | — | 284 | — | 0.00791 |
| Comp 1 | 20.8 | — | — | 284 | — | 0.00791 |
| Comp 2 | 17.8 | 3.2 | — | — | 130 | 0.00492 |
| Comp 3 | 17.8 | 3.2 | — | — | 130 | 0.00492 |

The HDPE1 (high density polyethylene) employs TAISOX HDPE/9001, a product of Formosa Plastics Corporation, with a density of 0.951 g/cm$^3$, and a melting point of 130° C. The HDPE2 (high density polyethylene) employs TAISOX HDPE/8010 with a density of 0.956 g/cm$^3$, and a melting point of 134° C. The nickel powder employs AEE (Atlantic Equipment Engineering) NI-102 with a form of flake, a particle size of 3 μm, and a resistivity ranging from 6 μΩ-cm to 15 μΩ-cm. The tungsten carbide filler uses AEE WP-301 with a resistivity around 80 μΩ-cm and particle size of 1-5 μm. The titanium carbide (TiC) employs AEE TI-301 with a resistivity ranging from 180 μΩ-cm to 250 μΩ-cm and particle size of 1-5 μm.

The conductive fillers are not limited to those used in the above embodiments and any conductive fillers can be used in the surface mountable over-current protection device of the present application if it exhibits the following properties: (1) the particle size distribution ranging from 0.01 μm to 30 μm, preferably from 0.1 μm to 10 μm; (2) the aspect ratio of the particle below 500, or preferably below 30; and (3) the resistivity below 500 μΩ-cm. Accordingly, if the conductive filler is a metal powder, it could be nickel, cobalt, copper, iron, tin, lead, silver, gold, platinum, or an alloy thereof. If the conductive filler is a conductive ceramic powder, it could be titanium carbide (TiC), tungsten carbide (WC), vanadium carbide (VC), zirconium carbide (ZrC), niobium carbide (NbC), tantalum carbide (TaC), molybdenum carbide (MoC), hafnium carbide (HfC), titanium boride ($TiB_2$), vanadium boride ($VB_2$), zirconium boride ($ZrB_2$), niobium boride ($NbB_2$), molybdenum boride ($MoB_2$), hafnium boride ($HfB_2$), or zirconium nitride (ZrN). The conductive filler may be mixture, alloy, solid solution or core-shell structure of the aforesaid metal powders or conductive ceramic fillers. The conductive filler may comprise 70-96%, or preferably 75-95%, by weight of the PTC material layer. If the conductive filler uses tungsten carbide, the conductive filler may comprise 80-95% by weight of the PTC material layer.

The structures, dimensions, hold currents and the values of hold current per PTC area are given in Table 2, in which the hold currents are measured at 25° C.

TABLE 2

| | Form factor | FIG. | No. of electrode layers | Electrode area A1 ($mm^2$) | No. of conductors at sidewalls | Connecting conductor area A2 ($mm^2$): conductor area ($mm^2$) | Connecting conductor area A2 ($mm^2$): single upper electrode area | No. of PTC layers | PTC area A3 ($mm^2$) | Heat dissipation factor F = (A1 + A2)/A3 | Hold current (A) | Hold current divided by PTC area ($A/mm^2$) |
|---|---|---|---|---|---|---|---|---|---|---|---|---|
| Em 1 | 1206 | FIG. 6 | 4 | 2.718 | 2 | 0.872 | N/A | 1 | 4.563 | 0.787 | 4.7 | 1.03 |
| Em 2 | 1206 | FIG. 2 | 4 | 3.048 | 2 | 1.798 | N/A | 1 | 4.645 | 1.043 | 5.2 | 1.12 |
| Em 3 | 0805 | FIG. 6 | 4 | 1.448 | 2 | 0.791 | N/A | 1 | 2.516 | 0.890 | 2.7 | 1.07 |
| Em 4 | 0603 | FIG. 6 | 4 | 1.006 | 2 | 0.350 | N/A | 1 | 1.146 | 1.184 | 1.2 | 1.05 |
| Em 5 | 0603 | FIG. 10 | 6 | 1.006 | 2 | 0.472 | N/A | 2 | 2.292 | 0.645 | 2.4 | 1.05 |
| Em 6 | 0603 | FIG. 5 | 3 | 0.533 | 1 | 0.175 | 1.161 | 1 | 1.161 | 1.610 | 1.4 | 1.21 |
| Em 7 | 0402 | FIG. 6 | 4 | 0.364 | 2 | 0.480 | N/A | 1 | 0.480 | 1.757 | 0.7 | 1.46 |
| Em 8 | 0201 | FIG. 5 | 3 | 0.102 | 1 | 0.058 | 0.129 | 1 | 0.129 | 2.243 | 0.5 | 3.88 |
| Comp 1 | 1206 | FIG. 10 | 6 | 2.810 | 2 | 1.108 | N/A | 2 | 9.125 | 0.429 | 5.8 | 0.64 |
| Comp 2 | 0805 | FIG. 10 | 6 | 1.448 | 2 | 1.028 | N/A | 2 | 5.031 | 0.492 | 4.3 | 0.85 |
| Comp 3 | 1812 | FIG. 6 | 4 | 5.485 | 2 | 1.217 | N/A | 1 | 13.707 | 0.489 | 5.6 | 0.41 |

As shown in Table 2, the heat dissipation factors F of Em 1 to Em 8 are equal to or greater than 0.6, or equal to or greater than 0.8, 1, 1.5 or 2 in particular. The value of the hold current per unit PTC area R=hold current/($A_{PTC}$×the number of the PTC material layers). As to Em 1, the device includes a single PTC material layer and its form factor is 1206. It can be estimated that the area of the PTC material layer is about 4.563 $mm^2$. Accordingly, the value R=4.7 A/4.563 $mm^2$=1.03 $A/mm^2$. Given the area of the PTC material layer is usually equivalent to or slightly smaller than the covered area of the form factor, the covered area may be viewed as the area of PTC material layer in practical calculation.

It is observed from Table 2 that the hold current per unit PTC area is greater than 1 $A/mm^2$, and the smaller devices usually have larger heat dissipation factors and larger hold current per unit PTC material layer area. According to the structural design, the impact of heat dissipation efficiency to the hold current is more obvious for the smaller devices, especially for the devices of form factor 1206 or smaller ones. To the contrary, the heat dissipation factors F of Comp 1-3 are less than 0.5; accordingly the R values are smaller than 0.9 $A/mm^2$. Obviously, the size and heat dissipation factor of the device significantly affect the value R, i.e., the hold current divided by the area of the PTC material layer.

Figure 11:
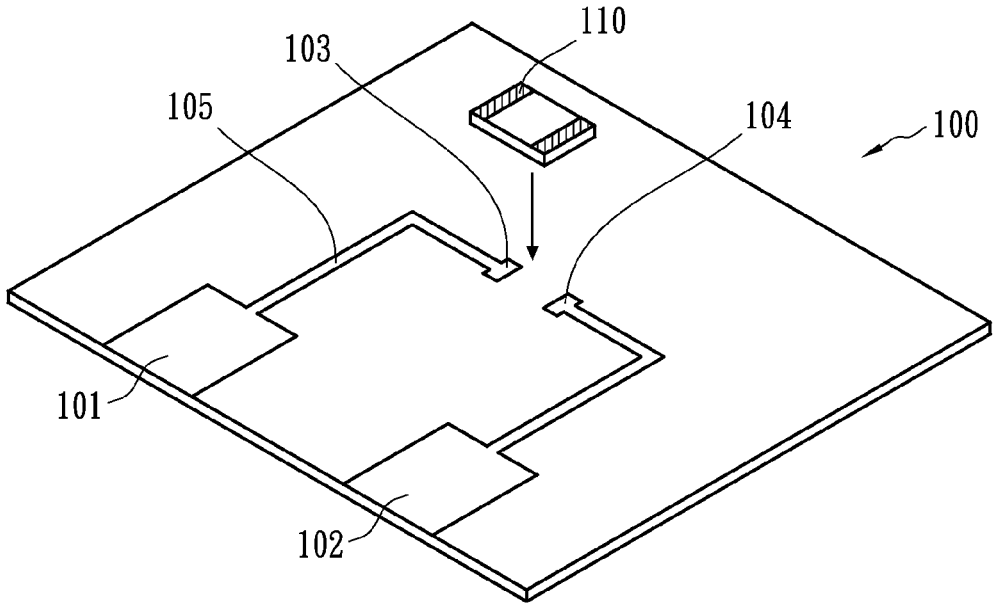
FIG. 11 shows a circuit board for testing hold current in accordance with an embodiment of the present application.

In general, the hold current is tested by securing the surface mountable over-current protection device to a test circuit board as shown in FIG. 11. The test circuit board 100 is provided with circuit layout in which conductive pads 101 and 102 are formed at a side and are connected to the nodes 103 and 104, respectively through conductive lines 105. When a surface mountable over-current protection device 110, which may be one of the aforesaid embodiments, undergoes hold current test, the first electrode and the second electrode are connected or soldered to the nodes 103 and 104 and the conductive pads 101 and 102 are clamped by wires to provide test current. The conductive line 105 of the test board 100 has a width between 10 mil and 100 mil, or between 10 and 30 mil in particular.

As mentioned above, heat dissipation influence to the hold current is relatively obvious for the small devices. When hold current is being tested, the conductive line 105 will influence the heat dissipation. Usually, the wider conductive line 105 has better heat dissipation efficiency, so that the measured hold current would be larger; accordingly larger value R of the hold current divided by the area of the PTC material layer can be obtained. For the device with a cover area less than 5 $mm^2$ or a form factor smaller than 1206, the influence of the width of the conductive line to heat dissipation is more obvious. Table 3 shows the hold currents and the R values of hold current divided by the area of the PTC material layer of a 0201 over-current protection device, which is tested by various conductive line widths.

TABLE 3

| Conductive line width | form factor | FIG. | No of electrode layers | Heat dissipation factor | Hold current (A) | PTC area ($mm^2$) | Hold current per PTC area ($A/mm^2$) |
|---|---|---|---|---|---|---|---|
| 10 mil | 0201 | FIG. 1 | 2 | 2.238 | 0.25 | 0.129 | 1.94 |
| 20 mil | 0201 | FIG. 1 | 2 | 2.238 | 0.34 | 0.129 | 2.63 |
| 30 mil | 0201 | FIG. 1 | 2 | 2.238 | 0.48 | 0.129 | 3.72 |
| 100 mil | 0201 | FIG. 1 | 2 | 2.238 | 0.75 | 0.129 | 5.81 |

It can be seen from Table 3 that the larger the conductive line width, the larger the hold current and the value R of hold current divided by the PTC material layer are. When the 0201 device is tested on a board with conductive lines of 10 mil to 100 mil, i.e., 0.254 mm to 2.54 mm, the hold current divided by the area of the PTC material layer can be up to 6 $A/mm^2$, or between about 1.5 to 6 $A/mm^2$ in particular.

Accordingly, if the heat dissipation factor F is greater than 0.6, the R value of the over-current protection device can exceed 1 $A/mm^2$. If the over-current protection device has larger heat dissipation factor, the R value can increase to, for example, 2 $A/mm^2$ or 3 $A/mm^2$. More particularly, the R value may be 4 $A/mm^2$, 5 $A/mm^2$ or 6 $A/mm^2$.

The surface mountable over-current protection device can be of various sizes; however, the present application is more applicable for the small devices. The smaller device would have smaller PTC material area, and therefore the ratio of the total surface area for heat dissipation to the area of the PTC material layer which generates heat is larger and the heat dissipation factor greater than 0.6 would be easily attained. To obtain a heat dissipation factor greater than 0.6, the area of the PTC material layer is preferably less than 20 $mm^2$, or less than 12 $mm^2$ or 8 $mm^2$ in particular.

Because the PTC material layer of the surface mountable over-current protection device has extremely low resistivity and optimal heat dissipation design, this novel technology is suitable to be applied to the devices of a form factor equal to or less than 1206 in obtaining low resistance and high hold current. The influence of the heat dissipation factor is more obvious for smaller devices.

To achieve an over-current protection at low temperature (e.g., to protect lithium batteries from over charge), a general PTC over-current protection device must trip at a lower temperature. Therefore, the PTC material layer used in the surface mountable over-current protection device of the present application can contain a crystalline polymer with a lower melting point (e.g., LDPE), or can use one or more crystalline polymers of which the crystalline polymer has a melting point below 115° C. The above LDPE can be polymerized using Ziegler-Natta catalyst, Metallocene catalyst or other catalysts, or can be copolymerized by vinyl monomer or other monomers such as butane, hexane, octene, acrylic acid, or vinyl acetate. Sometimes, to achieve over-current protection at high temperature or a specific objective, the compositions of the PTC material layer can totally or partially use crystalline polymer with high melting point; e.g., PVDF (polyvinylidene fluoride), PVF (polyvinyl fluoride), PTFE (polytetrafluoroethylene), or PCTFE (polychlorotrifluoro-ethylene).

The above crystalline polymers can also comprise a functional group such as an acidic group, an acid anhydride group, a halide group, an amine group, an unsaturated group, an epoxide group, an alcohol group, an amide group, a metallic ion, an ester group, and acrylate group, or a salt group. In addition, an antioxidant, a cross-linking agent, a flame retardant, a water repellent, or an arc-controlling agent can be added into the PTC material layer to improve the material polarity, electric property, mechanical bonding property or other properties such as waterproofing, high-temperature resistance, cross-linking, and oxidation resistance.

The metal powder or the conductive ceramic powder used in the present application could exhibit various types, e.g., spherical, cubic, flake, polygonal, spiky, rod, coral, nodular, staphylococcus, mushroom or filament type, and have aspect ratio between 1 and 1000. The conductive filler may be of various shapes e.g., high structure or low structure. In general, conductive fillers with high structure can improve the resistance repeatability of PTC material, and conductive fillers with low structure can improve the voltage endurance of PTC material.

In other embodiments of the present application, the conductive filler with lower conductivity, e.g., carbon black or graphite, can be mixed with conductive filler with higher conductivity, e.g., metal powder or conductive ceramic powder as long as the mixture (i.e., the mixed conductive filler) exhibits a resistivity below 0.2 Ω-cm and the heat dissipation factor and the value of the hold current thereof divided by the area of the PTC material layer are within the specific ranges.

If the PTC material has a resistivity less than 0.2 Ω-cm, it may be not able to withstand a voltage higher than 12 volts. To increase the voltage endurance, the PTC material layer may further comprise non-conductive filler. The non-conductive filler may be selected from: (1) an inorganic compound with the effects of flame retardant and anti-arcing; for example, zinc oxide, antimony oxide, aluminum oxide, silicon oxide, calcium carbonate, boron nitride, aluminum nitride, magnesium sulfate and barium sulfate; and (2) an inorganic compound with a hydroxyl group; for example, magnesium hydroxide, aluminum hydroxide, calcium hydroxide, and barium hydroxide. The particle size of the non-conductive filler is mainly between 0.05 μm and 50 μm and the non-conductive filler is 1% to 20% by weight of the total composition of the PTC material layer. Moreover, the thickness of the PTC material layer can be more than 0.2 mm, thereby increasing the capability to withstand a voltage larger than 12 volts. The inorganic compound can improve trip jump characteristic, thereby the trip jump R1/Ri can be controlled below 3, where Ri is initial resistance, R1 is the resistance after one hour when the device is tripped and returned to room temperature.

In view of the above, the traditional over-current protection device of small size SMDs exhibits insufficient hold current and thus loses many practical applications. The present application, overcoming the limitation of low hold current of the traditional over-current protection device applied to the small-sized SMDs, presents excellent resistivity (e.g., below 0.2 Ω-cm), voltage endurance (e.g., above 12V), resistance repeatability (e.g., R1/Ri below 3), and a high hold current (e.g., above 1 A/$mm^2$). Because the area of the surface mountable over-current protection device of the present application is smaller, more protection devices in the PTC plate can be produced so that the production will be more cost-effective.

The above-described embodiments of the present application are intended to be illustrative only. Numerous alternative embodiments may be devised by persons skilled in the art without departing from the scope of the following claims.

What is claimed is:

1. A surface mountable over-current protection device, comprising:

at least one PTC material layer having opposite first and second surfaces and a resistivity less than 0.2 Ω-cm, the PTC material layer comprising at least one crystalline polymer and at least one conductive filler of a resistivity less than 500μΩ-cm dispersed in the crystalline polymer;

a first connecting conductor capable of effectively dissipating heat generated from the PTC material layer;

a second connecting conductor capable of effectively dissipating heat generated from the PTC material layer;

a first electrode electrically connected to the first surface of the PTC material layer through the first connecting conductor;

a second electrode electrically connected to the second surface of the PTC material layer through the second connecting conductor; and at least one insulating layer disposed between the first electrode and the second electrode for electrically isolating the first electrode from the second electrode;

wherein the over-current protection device has a heat dissipation factor (A1+A2)/A3 greater than 0.6, A1 is the sum of areas of the first electrode and the second electrode, A2 is the sum of areas of the first connecting conductor and the second connecting conductor, and A3 is the product of an area of the PTC material layer and the number of the PTC material layer;

wherein the over-current protection device at 25° C., the value of hold current thereof divided by the product of the area of the PTC material layer and the number of the PTC material layer is greater than 1 A/$mm^2$.

2. The surface mountable over-current protection device of claim 1, wherein the conductive filler comprises metal powder or conductive ceramic powder.

3. The surface mountable over-current protection device of claim 1, wherein the conductive filler comprises nickel, cobalt, copper, iron, tin, lead, silver, gold, platinum, titanium carbide, tungsten carbide, vanadium carbide, zirconium carbide, niobium carbide, tantalum carbide, molybdenum carbide, hafnium carbide, titanium boride, vanadium boride, zirconium boride, niobium boride, tantalum boride, molybdenum boride, zirconium nitride or the mixture, alloy, solid solution or core-shell thereof.

4. The surface mountable over-current protection device of claim 1, wherein the conductive filler comprises 70%-96% by weight of the PTC material layer.

5. The surface mountable over-current protection device of claim 1, wherein the conductive filler has a size between 0.1 μm and 10 μm.

6. The surface mountable over-current protection device of claim 1, wherein the first connecting conductor comprises a conductive through hole, a conductive blind hole or a conductive sidewall surface at a first side of the over-current protection device and extends vertically.

7. The surface mountable over-current protection device of claim 6, wherein the second connecting conductor comprises a conductive through hole, a conductive blind hole or a conductive sidewall surface at a second side opposite to the first side of the over-current protection device and extends vertically.

8. The surface mountable over-current protection device of claim 1, wherein the first electrode and the second electrode are disposed at a same side of the over-current protection device.

9. The surface mountable over-current protection device of claim 8, wherein the first connecting conductor comprises a first metal foil in physical contact with the first surface of the PTC material layer, and the first metal foil extends horizontally.

10. The surface mountable over-current protection device of claim 1, wherein the PTC material layer is laminated between a first metal foil and a second metal foil, and two insulating layers are disposed on the first metal foil and the second metal foil, respectively.

11. The surface mountable over-current protection device of claim 10, wherein the first electrode comprises a pair of first electrode layers on the two insulating layers, and the second electrode comprises a pair of second electrode layers on the two insulating layers.

12. The surface mountable over-current protection device of claim 11, wherein the first connecting conductor connects the pair of first electrode layers and the first metal foil, and the second connecting conductor connects the pair of second electrode layers and the second metal foil.

13. The surface mountable over-current protection device of claim 1, wherein the heat dissipation factor is equal to or greater than 0.8.

14. The surface mountable over-current protection device of claim 1, wherein the PTC material layer has an area less than 20 $mm^2$.

15. The surface mountable over-current protection device of claim 1, wherein the over-current protection device is coupled to a conductive line of a width between 0.254 and 2.54 mm when it undergoes hold current testing.

16. The surface mountable over-current protection device of claim 1, wherein the over-current protection device at 25° C., the value of the hold current thereof divided by the product of the area of the PTC material layer and the number of the PTC material layer is equal to or less than 6 $A/mm^2$.

17. A surface mountable over-current protection device having opposite upper and lower surfaces, comprising:

at least one PTC device comprising a first metal foil, a second metal foil and a PTC material layer laminated therebetween, the PTC material layer having a resistivity less than 0.2 Ω-cm and comprising at least one crystalline polymer and at least one conductive filler of a resistivity less than 500μΩ-cm dispersed in the crystalline polymer;

a first connecting conductor capable of effectively dissipating heat generated from the PTC material layer;

a second connecting conductor capable of effectively dissipating heat generated from the PTC material layer;

a first electrode comprising a pair of first electrode layers at the upper and lower surfaces, and being electrically connected to the first metal foil through the first connecting conductor;

a second electrode comprising a pair of second electrode layers at the upper and lower surfaces, and being electrically connected to the second metal foil through the second connecting conductor;

at least one insulating layer disposed on the PTC device for electrically isolating the first electrode from the second electrode;

wherein the over-current protection device has a heat dissipation factor (A1+A2)/A3 greater than 0.6, A1 is the sum of areas of the first electrode and the second electrode, A2 is the sum of areas of the first connecting conductor and the second connecting conductor, and A3 is the product of an area of the PTC material layer and the number of the PTC material layer;

wherein the over-current protection device at 25° C., the value of hold current thereof divided by the product of the area of the PTC material layer and the number of the PTC material layers is greater than 1 $A/mm^2$.

18. The surface mountable over-current protection device of claim 17, wherein the insulating layer comprises a first insulating layer and a second insulting layer, the first insulating layer is disposed on the first metal foil, and the second insulating layer is disposed on the second metal foil.

19. The surface mountable over-current protection device of claim 18, wherein the pair of first electrode layers are disposed on the first and second insulating layers, and the pair of second electrode layers are disposed on the first and second insulating layers.

20. The surface mountable over-current protection device of claim 17, wherein the first connecting conductor connects the pair of the first electrode layers and the first metal foil, and the second connecting conductor connects the pair of the second electrode layers and the second metal foil.

21. The surface mountable over-current protection device of claim 17, wherein one of the first electrode layers is disposed on the first metal foil, and one of the second electrode layers is disposed on the second metal foil.

22. The surface mountable over-current protection device of claim 17, wherein the insulating layer compasses the PTC device.

23. The surface mountable over-current protection device of claim 17, wherein the first connecting conductor comprises a conductive through hole, a conductive blind hole or a conductive sidewall surface connecting the pair of the first electrode layers, and the second connecting conductor comprises a conductive through hole, a conductive blind hole or a conductive sidewall surface connecting the pair of the second electrode layers.

24. The surface mountable over-current protection device of claim 23, wherein the first connecting conductor further comprises a conductive post connecting the first metal foil and the first electrode layer, and the second connecting conductor further comprises another conductive post connecting the second metal foil and the second electrode layer.

25. The surface mountable over-current protection device of claim 17, wherein the conductive filler comprises nickel, cobalt, copper, iron, tin, lead, silver, gold, platinum, titanium carbide, tungsten carbide, vanadium carbide, zirconium carbide, niobium carbide, tantalum carbide, molybdenum carbide, hafnium carbide, titanium boride, vanadium boride, zirconium boride, niobium boride, tantalum boride, molybdenum boride, zirconium nitride or the mixture, alloy, solid solution or core-shell thereof.

26. The surface mountable over-current protection device of claim 17, wherein the conductive filler comprises 70%-96% by weight of the PTC material layer.

27. The surface mountable over-current protection device of claim 17, wherein the heat dissipation factor is equal to or greater than 0.8.

28. The surface mountable over-current protection device of claim 17, wherein the over-current protection device at 25° C., the value of hold current thereof divided by the product of the area of the PTC material layer and the number of the PTC material layers is equal to or less than 6 $A/mm^2$.

29. A surface mountable over-current protection device having opposite upper and lower surfaces, comprising:

a first PTC device comprising a first metal foil, a second metal foil and a PTC material layer laminated therebetween, the PTC material layer having a resistivity less than 0.2 Ω-cm and comprising at least one crystalline polymer and at least one conductive filler of a resistivity less than 500 Ω-cm dispersed in the crystalline polymer;

a second PTC device having the same composition and structure of the first PTC device and being superimposed on the first PTC device;

a first connecting conductor capable of effectively dissipating heat generated from the PTC material layer;

a second connecting conductor capable of effectively dissipating heat generated from the PTC material layer;

a first electrode comprising a pair of first electrode layers at the upper and lower surfaces, and being electrically connected to the first metal foil through the first connecting conductor;

a second electrode comprising a pair of second electrode layers at the upper and lower surfaces, and being electrically connected to the second metal foil through the second connecting conductor;

two first insulating layers disposed on the first metal foil of the first PTC device and the second metal foil of the second PTC device for electrically isolating the first electrode from the second electrode; and a second insulating layer disposed between the second metal foil of the first PTC device and the first metal foil of the second PTC device;

wherein the over-current protection device has a heat dissipation factor (A1+A2)/A3 greater than 0.6, A1 is the sum of areas of the first electrode and the second electrode, A2 is the sum of areas of the first connecting conductor and the second connecting conductor, and A3 is the product of an area of the PTC material layer and the number of the PTC material layer;

wherein the over-current protection device at 25° C., the value of hold current thereof divided by the product of the area of the PTC material layer and the number of the PTC material layer is greater than 1 $A/mm^2$.

30. The surface mountable over-current protection device of claim 29, wherein the conductive filler comprises nickel, cobalt, copper, iron, tin, lead, silver, gold, platinum, titanium carbide, tungsten carbide, vanadium carbide, zirconium carbide, niobium carbide, tantalum carbide, molybdenum carbide, hafnium carbide, titanium boride, vanadium boride, zirconium boride, niobium boride, tantalum boride, molybdenum boride, zirconium nitride or the mixture, alloy, solid solution or core-shell thereof.

31. The surface mountable over-current protection device of claim 29, wherein the conductive filler comprises 70%-96% by weight of the PTC material layer.

* * * * *